US005117525A

United States Patent [19]

Kärcher

[11] Patent Number: 5,117,525

[45] Date of Patent: Jun. 2, 1992

[54] TAKE-APART DRIVE-OVER BRIDGE WITH CANTILEVERS BETWEEN ITS DRIVE-OVERS

[75] Inventor: Hans J. Kärcher, Karben, Fed. Rep. of Germany

[73] Assignee: MAN Gutehoffnungshütte AG, Oberhausen, Fed. Rep. of Germany

[21] Appl. No.: 673,675

[22] Filed: Mar. 22, 1991

[30] Foreign Application Priority Data

Mar. 23, 1990 [DE] Fed. Rep. of Germany ..... 4009354

[51] Int. Cl.[5] ..... E01D 15/12

[52] U.S. Cl. ..... 14/2.5

[58] Field of Search ..... 14/1, 2.4

[56] References Cited

U.S. PATENT DOCUMENTS 4,723,333 2/1988 Williams ..... 14/2.4

FOREIGN PATENT DOCUMENTS 1162480 8/1969 United Kingdom ..... 14/2.4

*Primary Examiner*—William P. Neuder

*Attorney, Agent, or Firm*—Max Fogiel

[57] ABSTRACT

A take-apart drive-over bridge with cantilevers between the drive-overs. The two sections of drive-over (4) associated with each section of the bridge constitute, along with the section of cantilever (5) between them, a transport unit and are simultaneously secured to the corresponding drive-over and cantilever sections of the adjacent bridge section by the bridge-laying system, which consists essentially of a vehicle (1), a latticework outrigger (2), a main boom (3.1), and an auxiliary boom (3.2), while the bridge is being assembled. The two sections of drive-over associated with each bridge section and the section of cantilever, which is in two halves, slide together for transport and apart for assembly.

The two drive-overs and the cantilever have U-shaped latticework structural sections with uprights (11 or 16) and horizontals (12 or 19) at the top.

The horizontals (19) and beams (15) are removable.

The horizontals and the beams can alternatively have an articulation (29) at each end and another articulation (30) in the middle along with means of securing the articulations in place and can fold together into a transport position.

9 Claims, 5 Drawing Sheets

TAKE-APART DRIVE-OVER BRIDGE WITH CANTILEVERS BETWEEN ITS DRIVE-OVERS

BACKGROUND OF THE INVENTION

Up-to-date take-apart bridges for use during disasters etc. must be capable not only of being emplaced in a very short time and adapted to various spans but also of being transported in widths that are permissible on ordinary roads. Take-apart bridges for military use in the field should also, in order to prevent discovery, present as low a silhouette as possible.

One technique frequently employed for emplacing a bridge of this type involves launching it from the near to the far bank over the span that is to be covered. When the spans are wide (e.g. more than 35 m), it is usually impossible to launch the bridge itself over the span because too heavy a counterweight would be needed to maintain equilibrium at the near bank. A known practice in such cases is to initially launch a cantilever (probe) that weighs considerably less per unit of length and then slide the bridge itself out over the cantilever. The bridge is then supported on the cantilever until its outer end reaches the far bank.

Another practice known in conjunction with drive-over bridges is to exploit the space between the drive-over to accommodate the cantilevers, which are left there once the bridge has been emplaced to reduce the load to be accepted by the structure.

Known take-apart drive-over bridges cannot simultaneously satisfy all the requirements of rapid emplacement over long spans, transportation in permissible widths, and as low a silhouette as possible. Either the sections of the cantilever and drive-overs are assembled separately on the near bank, which takes a long time, or, although the bridge-section transport units already comprise the two drive-over sections, they are too wide for ordinary streets and roads and do not as yet include an associated cantilever section.

SUMMARY OF THE INVENTION

The invention avoids these drawbacks in that the two sections of drive-over associated with each section of the bridge constitute, along with the section of cantilever between them, a transport unit and are simultaneously secured to the corresponding drive-over and cantilever sections of the adjacent bridge section by the bridge-laying system, which consists essentially of a vehicle, a latticework outrigger, a main boom, and an auxiliary boom, while the bridge is being assembled, whereby the two sections of drive-over associated with each bridge section and the section of cantilever, which is in two halves, slide together for transport and apart for assembly.

The two drive-overs and the cantilever in one embodiment of the invention have U-shaped latticework structural sections with uprights on each side and horizontals at the top.

One particularly simple and practical approach is attained in that the drive-over rolls along the cantilever and the cantilever rolls along the boom on rollers that travel back and forth in grooves in the lengths of structural section that comprise the lower chord of the cantilever and the lower chord of the drive-over.

The horizontals in the cantilever U-shaped latticework structural sections and the beams, which are on the same level as the part of the roadway above them, can be removable or can have an articulation at each end and another articulation in the middle along with means of securing the articulations in place and can fold together into a transport position like an articulated lever. It is as an alternative also possible for the horizontals and beams to be in one piece and have articulations that can be secured in place at one end and a connection that can be disestablished at the other end. In this version, accordingly, the horizontals and beams are folded to one side for transport.

The latticework structural sections of the drive-overs in another version of the invention are more or less L-shaped, with only a single side, and have one upright on either the outside or the inside and one horizontal at the top.

DESCRIPTION OF THE PREFERRED EMBODIMENTS

Figure 1:
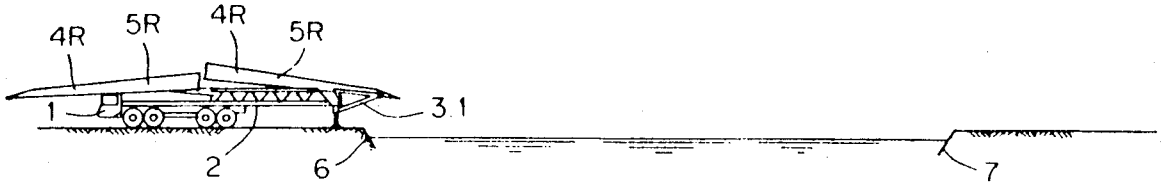
FIGS. 1 to 10 are schematic views illustrating various phases in sequence of assembly and implacement carried out by bridge-laying vehicle, in accordance with the present invention.

FIGS. 1 through 10 illustrate various phases of assembly and emplacement being carried out by a bridge-laying vehicle 1 with a latticework outrigger 2, a main boom 3.1, an auxiliary boom 3.2, two drive-overs 4 consisting of several sections fastened together, and a cantilever 5 comprising two halves consisting of several sections. The cantilever sections are the same length as their associated drive-over sections. How many bridge sections are employed depends on how long the span to be bridged is and on the surface dimensions of the near bank 6 and far bank 7.

Figure 2:
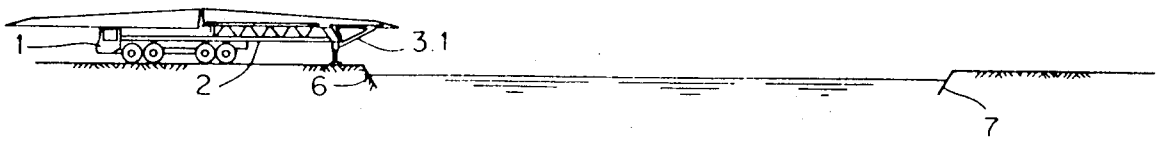
Figure 3:
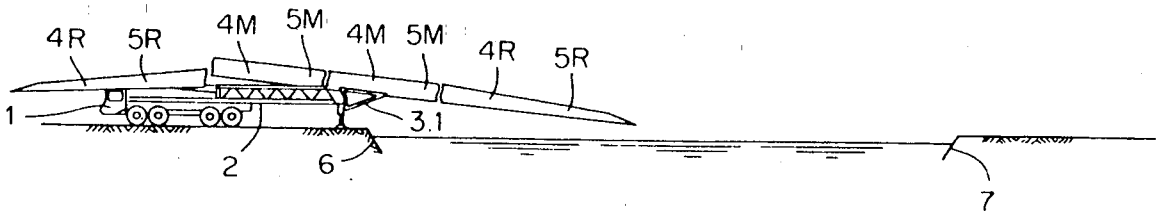
Figure 4:
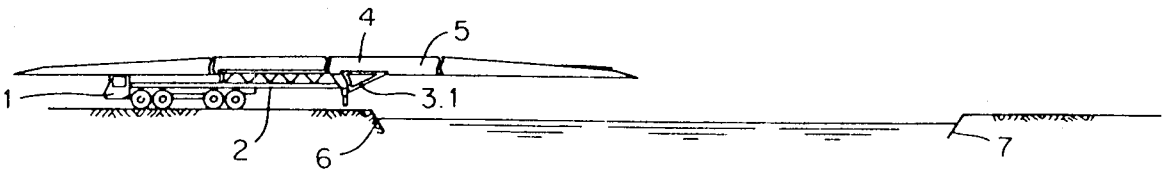

FIG. 1 illustrates four ramp sections 4R of a drive-over 4 and four ramp half-sections 5R of a cantilever 5 ready for fastening together on vehicle 1. The vehicle rests on near bank 6 with its outrigger 2 extended and supported. All of the sections involved are secured together simultaneously by pivoting main boom 3.1 around its point of articulation. FIG. 2 illustrates the same system once the sections have been fastened together. FIGS. 3 and 4 illustrate the simultaneous attachment ramp sections 4R and 5R to middle sections 4M and 5M, again by pivoting main boom 3.1. Another bridge section consisting of additional middle sections is simultaneously attached to the bridge section consisting of middle sections 4M and 5M in the same way, etc. although this process is not illustrated. The sections can be unfastened by pivoting the boom in the opposite direction.

Figure 5:
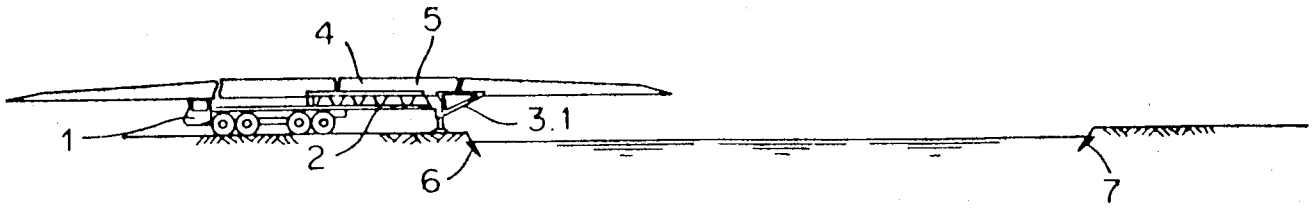
Figure 6:
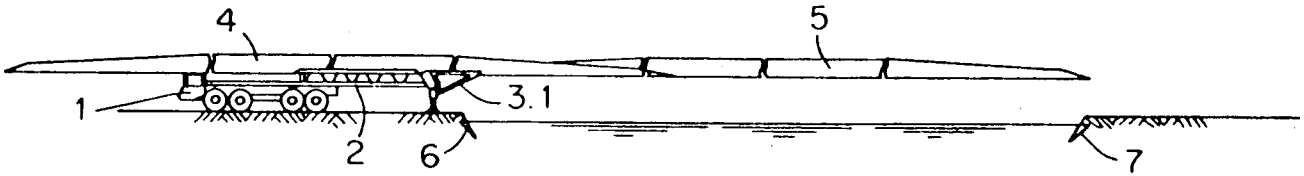
Figure 7:
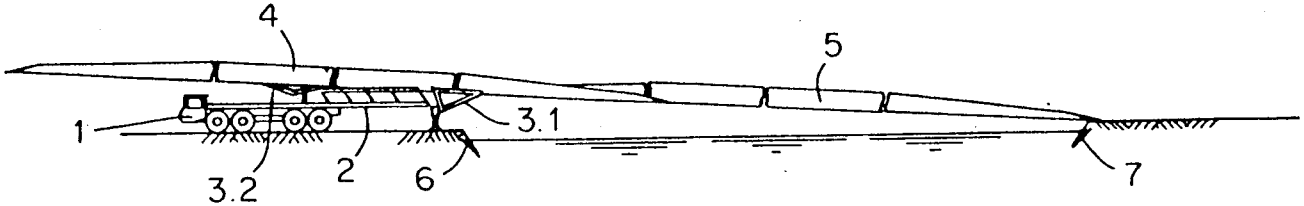
Figure 8:
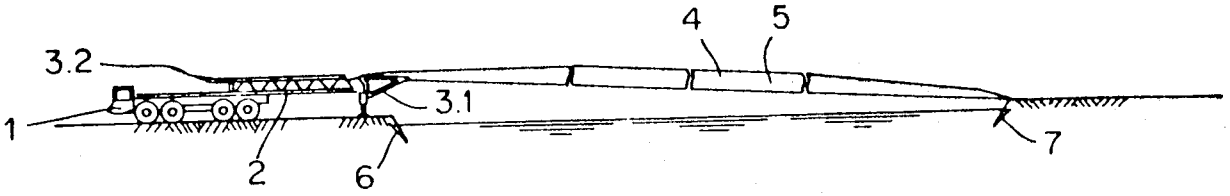
Figure 9:
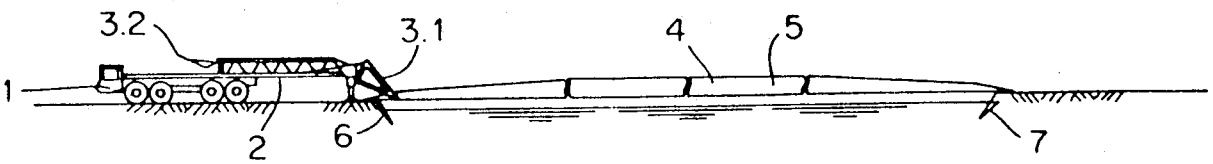
Figure 10:
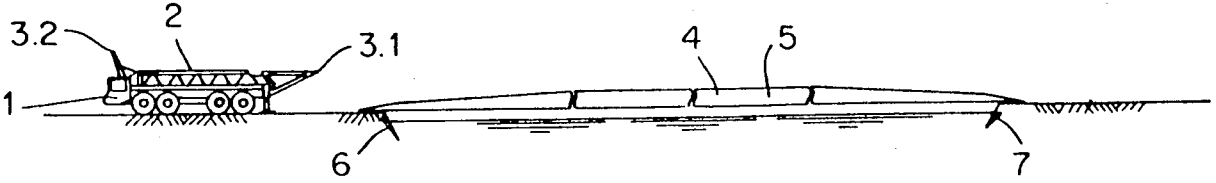

FIG. 5 illustrates a bridge completely assembled on vehicle 1 from drive-overs 4 and cantilevers 5. In the next phase, illustrated in FIG. 6, cantilever 5 is extended until its far end is at the same level as far bank 7, with auxiliary boom 3.2 helping to position drive-overs 4 vertically and horizontally. Main boom 3.1 now pivots up, lifting the near end of the drive-over and lowering the far end of cantilever 5 until it rests on far bank 7 as illustrated in FIG. 7. Drive-overs 4 are now slid across, resting on cantilever 5 until their far ends also attain far bank 7 as illustrated in FIG. 8. Main boom 3.1 now lowers the near ends of drive-overs 4 and cantilever 5 as illustrated in FIG. 9. Once the supports have been inserted, outrigger 2 is retracted onto vehicle 1, terminating the assembly procedure. The bridge is now ready to use as illustrated in FIG. 10. The bridge can be disassembled from either bank by following the reverse procedure.

Figure 11:
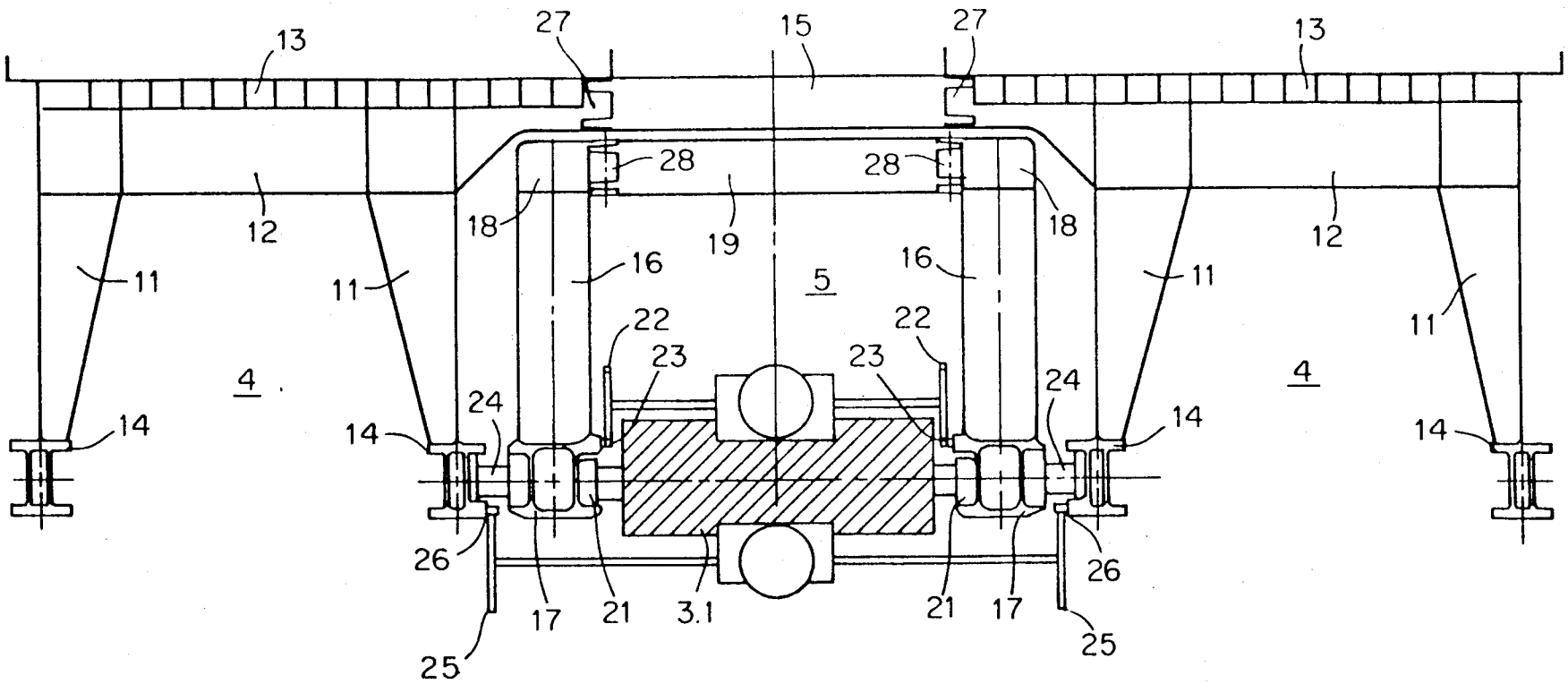
FIG. 11 is a cross-sectional view of the bridge in vicinity of a main boom and during implacement.

FIG. 11 illustrates the cross-section of the bridge in the vicinity of main boom 3.1 and during emplacement. The cross-section consists of two drive-overs 4 and of a cantilever 5, which comprises two halves. Drive-overs 4 are lengths of preferably U-shaped latticework section with uprights 11 and horizontals 12 that connect roadway components 13 to lower chords 14. They are transversely connected more or less at the same level as roadway components 13 by beams 15. Cantilever 5 also is also a length of preferably U-shaped latticework section with uprights 16 that connect lower chords 17 to upper chords 18. Upper chords 18 are again connected together by horizontals 19.

Secured to main boom 3.1 are a number of rollers 21 that engage grooves along the sides of lower chords 17 and support the cantilever. Pinwheels 22 rotate on main boom 3.1 and engage pins 23 distributed along lower chords 17 for the purpose of advancing cantilever 5 longitudinally.

The lower chord 14 on each drive-over 4 similar rests on a number of rollers 24 in the associated lower chord 17 of cantilever 5. Pinwheels 23 rotate on main boom 3.1 and engage pins 26 distributed along lower chords 14 for the purpose of advancing drive-overs 4 longitudinally.

Beams 15, which connect drive-overs 4 transversely, can be extracted once fasteners 27 have been removed. Horizontals 19, which connect cantilever upper chords 18, can also be extracted once fasteners 28 have been removed. Once beams 15 and horizontals 19 have been removed, the halves of the bridge section, each of which comprises one section of a drive-over 4 and half a section of a cantilever 5, can be brought together transversely.

Figure 12:
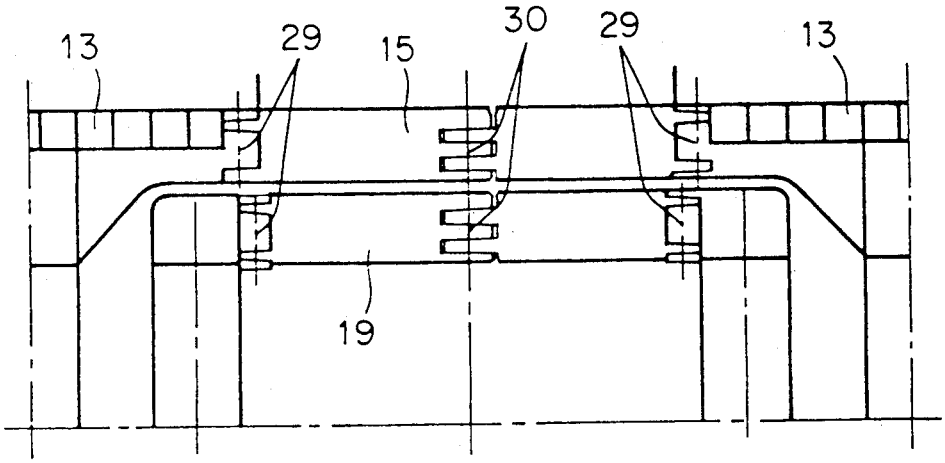
FIG. 12 is a schematic view of another embodiment of the arrangement shown in FIG. 11.

Beams 15 and horizontals 19 can alternatively be provided as illustrated in FIG. 12 with articulations 29 at each end and with articulations 30 in the middle, allowing them to fold together when the half bridge sections are slid together. At least two (29 & 30) of the three articulations in each beam 15 and each horizontal 19 can then be designed in a way that is in itself known with stops.

As another alternative to the approach illustrated in FIG. 11, beams 15 and horizontals 19 can have articulations 29 that can be secured at one end and be attached at the other end to the horizontals 12 in one drive-over 4 and to the upper chord 18 in cantilever 5 by inserted connections 28 and 28 that can be released. When the half bridge sections are slid together for transport, beams 15 and horizontals 19 will fold down along one side of drive-over 4.

Figure 13:
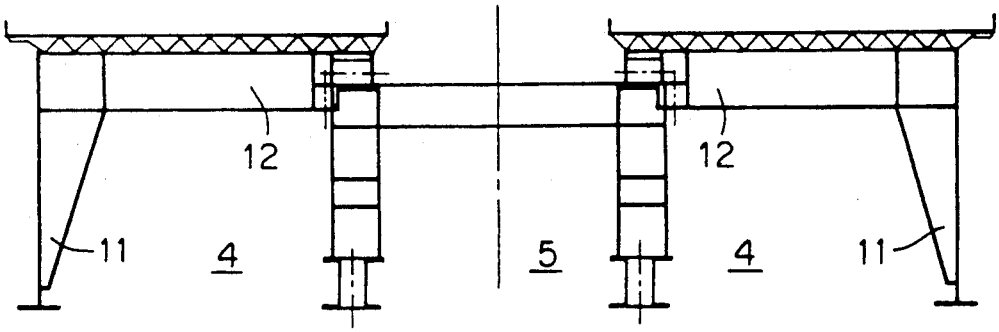
FIG. 13 is a schematic view of a still further embodiment of the arrangement of FIG. 11, in accordance with the present invention.

FIG. 13 illustrates another version of the invention, wherein the latticework structural sections of drive-overs 4 are more or less L-shaped, with only a single side, and have one upright 11 on the outside and one horizontal 12 at the top.

I claim:

1. A take-apart drive-over bridge with a bridge-laying system comprising: a plurality of drive-overs; cantilevers between said drive-overs; said bridge being formed of bridge sections, each drive-over having two sections associated with a bridge section, a cantilever having two halves and being located between said two drive-over sections, said two drive-over sections with said cantilever between them comprising a transport unit, said two drive-over sections being simultaneously secured to corresponding drive-over and cantilever sections of an adjacent bridge section by said bridge-laying system; a vehicle; a latticework outrigger, a main boom and an auxiliary boom on said vehicle for assembling and laying the bridge, said two drive-over sections and said cantilever with two halves sliding together to form said transport unit, and said two drive-over sections and said cantilever with two halves sliding apart for assembly of the bridge.

2. A take-apart drive-over bridge as defined in claim 1, wherein said drive-overs and said cantilever have U-shaped latticework structural sections with uprights and horizontals at a top side of said structural sections.

3. A take-apart drive-over bridge as defined in claim 1, including lengths of structural sections comprising a lower chord of said cantilever and a lower chord of the drive-over, said structural sections having grooves; rollers for traveling back and forth in said grooves; said drive-over rolling along said cantilever and said cantilever rolling along said main boom on said rollers.

4. A take-apart drive-over bridge as defined in claim 2, including beams on a same level as a part of roadway above said horizontals, said horizontals in the cantilever with U-shaped latticework structural sections and said beams being removable.

5. A take-apart driveover bridge as defined in claim 2, including beams on a same lev el as roadway above said horizontals; a first articulation at each end of said horizontals and said beams; a second articulation at centers of said horizontals and said beams; means for securing the articulations in place, said horizontals and beams being foldable together as an articulated lever in said transport unit.

6. A take-apart drive-over bridge as defined in claim 2, including beams on a same level as a part of roadway above said horizontals, said horizontals and beams being in one piece with articulations securable in place at one end of said horizontals and beams; and connections that are disengageable with said horizontals in said drive-over and with an upper chord of said cantilever for folding to one side in said transport unit.

7. A take-apart drive-over bridge as defined in claim 1, wherein said drive-overs have substantially L-shaped latticework structural sections with only a single side and with one upright and one horizontal at a top side of said structural sections.

8. A take-apart drive-over bridge with a bridge-laying system comprising: a plurality of drive-overs; cantilevers between said drive-overs; said bridge being formed of bridge sections, each drive-over having two sections associated with a bridge section, a cantilever having two halves and being located between said two drive-over sections, said two drive-over sections with said cantilever between them comprising a transport unit, said two drive-over sections being simultaneously secured to corresponding drive-over and cantilever sections of an adjacent bridge section by said bridge-laying system; a vehicle; a latticework outrigger, a main boom and an auxiliary boom on said vehicle for assembling and laying the bridge, said two drive-over sections and said cantilever with two halves sliding together to form said transport unit, and said two drive-over sections and said cantilever with two halves sliding apart for assembly of the bridge; said drive-overs and said cantilever having U-shaped latticework structural sections with uprights and horizontals at atop side of said structural sections; length of auxiliary structural sections comprising a lower chord of said cantilever and a lower chord of the drive-over, said auxiliary structural sections having grooves; rollers for traveling back and forth in said grooves; said driveover rolling along said cantilever and said cantilever rolling along said main boom on said rollers; beams on a same level as a part of roadway above said horizontals, said horizontals in the cantilever with U-shaped latticework structural sections and said beams being removable; a first articulation at each end of said horizontals and said beams; a second articulation at centers of said horizontals and said beams; means for securing the articulations in place, said horizontals and beams being foldable together as an articulated lever in said transport unit.

9. A take-apart drive-over bridge with a bridge-laying system comprising: a plurality of drive-overs; cantilevers between said drive-overs; said bridge being formed of bridge sections, each drive-over having two sections associated with a bridge section, a cantilever having two halves and being located between said two drive-over sections, said two drive-over sections with said cantilever between them comprising a transport unit, said two drive-over sections being simultaneously secured to corresponding drive-over and cantilever sections of an adjacent bridge section by said bridge-laying system; a vehicle; a latticework outrigger, a main boom and an auxiliary boom on said vehicle for assembling and laying the bridge, said two drive-over sections and said cantilever with two halves sliding together to form said transport unit, and said two drive-over sections and said cantilever with two halves sliding apart for assembly of the bridge; said drive-overs and said cantilever having U-shaped latticework structural sections with uprights and horizontals at a top side of said structural sections; lengths of auxiliary structural sections comprising a lower chord of said cantilever and a lower chord of the drive-over, said auxiliary structural sections having grooves; rollers for traveling back and forth in said grooves; said drive-over rolling along said cantilever and said cantilever rolling along said main boom on said rollers; beams on a same level as a part of roadway above said horizontals, said horizontals in the cantilever with U-shaped latticework structural sections and said beams being removable; a first articulation at each end of said horizontals and said beams; a second articulation at centers of said horizontals and said beams; means for securing the articulations in place, said horizontals and beams being foldable together as an articulated lever in said transport unit; said horizontals and beams being in one piece with said articulations securable in place at one end of said horizontals and beams; connections that are disengageable with said horizontals in said drive-over and with an upper chord of said cantilever for folding to one side in said transport unit; said drive-overs having substantially L-shaped latticework structural section with only a single side and with one upright and one horizontal at a top side of said L-shaped latticework structural sections.

* * * * *